US011613838B2

(12) United States Patent
Lee et al.

(10) Patent No.: US 11,613,838 B2
(45) Date of Patent: Mar. 28, 2023

(54) LAUNDRY TREATING APPARATUS

(71) Applicant: LG Electronics Inc., Seoul (KR)

(72) Inventors: Kilryong Lee, Seoul (KR); Junyoung Kim, Seoul (KR); Bokyung Suh, Seoul (KR)

(73) Assignee: LG Electronics Inc., Seoul (KR)

( * ) Notice: Subject to any disclaimer, the term of this patent is extended or adjusted under 35 U.S.C. 154(b) by 286 days.

(21) Appl. No.: 16/751,781

(22) Filed: Jan. 24, 2020

(65) Prior Publication Data

US 2020/0248379 A1 Aug. 6, 2020

(30) Foreign Application Priority Data

Feb. 1, 2019 (KR) ..... 10-2019-0014082
Apr. 1, 2019 (KR) ..... 10-2019-0038032

(51) Int. Cl.
*D06F 39/04* (2006.01)
*D06F 103/52* (2020.01)

(52) U.S. Cl.
CPC ..... *D06F 39/04* (2013.01); *D06F 2103/52* (2020.02)

(58) Field of Classification Search
CPC ..... D06F 39/04; D06F 2103/52
USPC ..... 68/15
See application file for complete search history.

(56) References Cited

U.S. PATENT DOCUMENTS

2013/0198970 A1* 8/2013 Doh ..... D06F 58/26 8/137
2018/0360292 A1* 12/2018 Lee ..... A47L 15/08

FOREIGN PATENT DOCUMENTS

| | | |
|---|---|---|
| CN | 106283533 | 1/2017 |
| DE | 19844568 | 10/1999 |
| DE | 102010063758 | 6/2012 |
| KR | 20030092185 | 12/2003 |
| KR | 1020050115815 | 12/2005 |
| KR | 20070017774 | 2/2007 |
| KR | 20160023295 | 3/2016 |

OTHER PUBLICATIONS

KR20050115815A—machine translation (Year: 2005).*
Office Action in Chinese Appln. No. 202010078713.5, dated Mar. 17, 2022, 14 pages (with English translation).
Office Action in German Appln. No. 102020200855.8, dated Apr. 8, 2022, 12 pages (with English translation).

* cited by examiner

*Primary Examiner* — Tinsae B Ayalew
(74) *Attorney, Agent, or Firm* — Fish & Richardson P.C.

(57) ABSTRACT

A laundry treating apparatus includes: a cabinet; a tub provided inside the cabinet; a drum provided inside the tub; an electric heater coupled to a bottom portion of the tub to heat wash water inside the tub; and a bracket provided at the tub to support the electric heater to be spaced apart from the bottom. The bracket includes an electric heater receiving portion in which the electric heater is received therein, and a sensing portion protruding upward at an upper one side of the electric heater receiving portion to sense the mis-assembly of the electric heater. As a result, the mis-assembly of the electric heater may be quickly recognized.

20 Claims, 11 Drawing Sheets

LAUNDRY TREATING APPARATUS

CROSS-REFERENCE TO RELATED APPLICATION

Pursuant to 35 U.S.C. § 119(a), this application claims the benefit of an earlier filing date of and the right of priority to Korean Patent Application Nos. 10-2019-0014082 and 10-2019-0038032, filed on Feb. 1, 2019 and Apr. 1, 2019, respectively, the contents of which are incorporated by reference herein in their entirety.

BACKGROUND

1. Technical Field

The present disclosure relates to a laundry treating apparatus.

2. Description of the Related Art

As is well known, a laundry treating apparatus is a type of apparatus for treating (decontaminating) clothes or laundry through a washing process, a rinsing process and/or a dehydration process. The laundry treating apparatus may also be configured to have a drying function of drying laundry after the washing process, the rinsing process and/or the dehydration process. The laundry includes washable items such as bedding like comforters, curtains, rag dolls, and the like.

The laundry treating apparatus includes a cabinet, a tub provided inside the cabinet, and a rotating tub (drum) rotatably provided inside the tub. The cabinet is provided with a detergent box to supply detergent into the tub.

The tub is provided with an electric heater to heat wash water. A wash water collection space is disposed at a bottom portion of the tub to collect wash water. The electric heater is coupled to the wash water collection space.

The wash water collection space is provided with an electric heater bracket (hereinafter, referred to as a "bracket") for supporting the electric heater to be spaced apart from a bottom surface of the wash water collection space. The bracket is provided with an electric heater receiving portion to receive and couple to the electric heater therein.

However, in such a laundry treating apparatus in the related art, there is a problem that the electric heater is not properly inserted into the electric heater receiving portion of the bracket when the electric heater is coupled to the bracket, and in case where the electric heater is disposed at an outside of the electric heater receiving portion, it is not easily detected by the operator.

In consideration of these problems, a heater bracket provided with a support piece in contact with an electric heater to suppress the mis-assembly of the electric heater at an upper side of an electric heater receiving portion is publicly known.

However, in such a laundry treating apparatus in the related art, the support piece is bent at an upper center of the heater receiving portion, and there is a problem that a relatively large amount of material is introduced during the formation of the heater bracket, thereby increasing the amount of material consumption.

In addition, when the support piece is disposed at an upper center of the heater receiving portion, in case where the electric heater is inserted into and disposed at an upper side of the support piece, there is a problem that it is not easy to detect the mis-assembly of the electric heater.

PRIOR ART DOCUMENTS (Patent Document 1) KR20030092185 A
(Patent Document 2) KR20050115815 A

SUMMARY

Accordingly, an aspect of the present disclosure is to provide a laundry treating apparatus having a bracket capable of quickly recognizing the mis-assembly of an electric heater.

Furthermore, another aspect of the present disclosure is to provide a laundry treating apparatus having a bracket capable of reducing the amount of material consumption during the manufacture of the bracket.

In addition, still another aspect of the present disclosure is to provide a laundry treating apparatus having a bracket that allows an electric heater to be disposed at a horizontal position where the electric heater is normally assembled and at an inclined position where the electric heater is mis-assembled and inclined, respectively.

Moreover, yet still another aspect of the present disclosure is to provide a laundry treating apparatus having a bracket capable of suppressing the interference of the electric heater from occurring when the electric heater is mis-assembled at an upper side of the heater receiving portion.

In order to solve the foregoing problems, a laundry treating apparatus according to the present disclosure is technically characterized in that a sensing portion protrudes upward at an upper side of a bracket, and an electric heater is inclined by the sensing portion.

More specifically, the bracket may include an electric heater receiving portion in which the electric heater is received therein, and the sensing portion may protrude upward at a point moved to one side from the center of the electric heater receiving portion, and thus the electric heater may be unilaterally supported by the sensing portion and inclined when the electric heater is incorrectly inserted into an upper side of the heater receiving portion, thereby quickly recognizing that the electric heater is mis-assembled.

The laundry treating apparatus may include a cabinet; a tub provided inside the cabinet; and a drum provided inside the tub.

The bracket may be provided at a bottom portion of the tub to support the electric heater to be spaced apart from the bottom of the tub.

The electric heater may be provided with a protection tube and a heating wire provided inside the protection tube to generate heat when power is applied.

The protection tube of the electric heater is configured to include a plurality of straight tube portions arranged in parallel to each other linearly and a curved tube portion connecting the straight tube portions.

The bracket may be made of a metal member, and the electric heater receiving portion may have an inverted-"U" cross-sectional shape that is open downward to receive the electric heater therein.

The electric heater receiving portion may include both side surface portions and an upper surface portion, and the sensing portion may protrude upward at a point moved to one side along a left-right direction from the center of the upper surface portion.

As a result, when the electric heater is normally assembled (inserted) into the electric heater receiving portion, the electric heater may be disposed at a horizontal position. On the contrary, when the electric heater is mis-assembled (incorrectly inserted) into an upper side of the electric heater receiving portion, either one side of the electric heater may be supported by the sensing portion, and the other side thereof may be supported by the upper surface portion of the electric heater receiving portion, and thus the electric heater may be disposed at an inclined position inclined to either one side. Accordingly, the operator may easily identify whether the electric heater is normally assembled or not based on whether it is at a normally assembled horizontal position or mis-assembled inclined position according to a disposition form of the electric heater.

The sensing portion may be configured such that a preset compressive force is applied from an inside of the electric heater receiving portion to plastically deform part of the electric heater receiving portion to be recessed upward from the inside and to protrude to the outside.

As a result, an amount of material consumption of the bracket may be significantly reduced, compared to bending the sensing portion at one side of the electric heater receiving portion.

The sensing portion may decrease in width toward the upper side.

More specifically, the sensing portion may be defined such that a left-right width of the sensing portion gradually decreases along a left-right direction of the cabinet.

In addition, the sensing portion may be defined such that a front-rear width of the sensing portion gradually decreases along a front-rear direction of the cabinet.

As a result, the sensing portion may be easily defined.

In addition, when the electric heater is erroneously inserted into an upper side rather than an inside of the electric heater receiving portion, interference occurrence between the electric heater and the sensing portion may be reduced.

The sensing portion may include both side surface portions and an upper surface portion.

The sensing portion may have an inverted-"U" cross-sectional shape with the lower side open.

A side surface portion disposed close to the center of the electric heater receiving portion along a left-right direction of the cabinet between both side surface portions of the sensing portion may include a guide inclined surface defined to be inclined downward toward the center.

As a result, when the electric heater is mis-assembled at an upper side of the electric heater receiving portion, the electric heater may be guided by the guide inclined surface and easily switched to the inclined position.

More specifically, the guide inclined surface may be defined such that a front-rear width thereof gradually decreases along a front-rear direction of the cabinet.

The guide inclined surface may have a triangular shape.

The sensing portion may be configured such that an upper surface thereof is inclined downward in a rear direction and connected to an upper surface of the electric heater receiving portion.

As a result, when the electric heater is mis-assembled at the upper side of the electric heater receiving portion, the electric heater may smoothly move along an upper surface of the sensing portion when the electric heater is brought into contact with the sensing portion, thereby suppressing interference occurrence between the electric heater and the sensing portion.

The bracket may include a base; and a supporter spaced apart upward from the base to support the electric heater from below.

The supporter may be disposed in a rear region of the electric heater receiving portion.

The supporter may include an inclined portion inclined upward in a rear direction from the base.

As a result, the electric heater inserted into the electric heater receiving portion may be smoothly spaced apart from the bottom.

The supporter may further include a round portion defined in a curved cross-sectional shape at an upper end of the inclined portion.

As a result, the occurrence of interference of the electric heater may be suppressed to facilitate the assembly of the electric heater.

The round portion may be disposed parallel to the base.

As a result, the electric heater may be horizontally supported by the round portion and disposed at the horizontal position.

The center of the supporter may be provided with a screw fastening portion bent downward.

The screw fastening portion may be disposed at the center of the supporter.

A cut-out portion defined by cutting out the base may be provided at a front side of the supporter, and the cut-out portion may be disposed at both sides of the screw fastening portion, respectively.

A wash water collection space is disposed at a bottom portion of the tub to collect wash water.

The wash water collection space is provided with a bracket coupling portion to which the bracket is coupled.

The bracket coupling portion may be made of a plastic member.

The bracket coupling portion may be integrally formed during the formation of the tub.

The bracket may be provided with a screw fastening portion, which is fastened to the bracket coupling portion by a screw.

The screw fastening portion may protrude downward from the base of the bracket.

The bracket coupling portions may be spaced apart from each other so that both side portions of the bracket are respectively inserted at a predetermined width.

Here, the bracket coupling portion may be spaced apart from each other along a left-right direction of the cabinet.

The bracket coupling portion may include an upper support rib and a lower support rib that support the bracket while being in contact therewith, at upper and lower sides of the bracket, respectively.

The bracket may be provided with an engaging piece to be caught by the bracket coupling portion after the bracket is inserted into the bracket coupling portion so as to suppress the separation.

The engaging pieces may be disposed at both sides of the bracket, respectively.

The engaging pieces may be disposed in plural to be spaced apart from each other along a front-rear direction of the cabinet.

The engaging piece may gradually decrease in width toward the front along a front-rear direction of the cabinet.

The engaging piece may be defined with a tip portion at the front.

The engaging piece may be inclined upward toward the front of the bracket.

The engaging piece may be inclined upward toward the front of the bracket coupling portion, and thus the tip portion may be inserted into the bracket coupling portion while sliding in contact with an inner ceiling of the bracket coupling portion during the insertion into the bracket coupling portion, and engaged into an inner ceiling surface of the bracket coupling portion during the separation, thereby suppressing the bracket from being unintentionally separated from the bracket coupling portion.

As described above, according to an embodiment of the present disclosure, a sensing portion protruding upward to detect the mis-assembly of an electric heater may be provided at one side of the bracket, thereby quickly recognizing the mis-assembly of the electric heater.

The sensing portion may be recessed from an inner side of the electric heater receiving portion to protrude to an outside thereof, thereby significantly reducing an amount of material consumption during the manufacture of the bracket.

The sensing portion may be defined to decrease in width toward the upper side, thereby facilitating the formation of the sensing portion.

The sensing portion may be provided with a guide inclined surface inclined downward toward the center of a side surface portion disposed close to a middle between both side surface portions, thereby smoothly switching the electric heater to the inclined position during the mis-assembly of the electric heater.

An upper surface of the sensing portion may be inclined downward toward the rear side and connected to an upper surface portion of the electric heater receiving portion, thereby suppressing interference occurrence between the electric heater and the sensing portion when the electric heater is mis-assembled at an upper side of the electric heater receiving portion.

The bracket may include a base and a supporter spaced apart from the base, thereby supporting the electric heater to be spaced apart from the bottom.

The supporter may include an inclined portion inclined upward toward the rear side and a round portion having a curved cross-sectional shape at an end portion of the inclined portion, thereby facilitating the normal assembly of the electric heater.

A bracket coupling portion may be disposed at a bottom surface of a tub, and the bracket may be provided with an engaging piece that is caught by the bracket coupling portion, thereby suppressing the bracket from being unintentionally released subsequent to the assembly of the bracket.

The sensing portion may be defined such that a preset compressive force is applied from an inside of the electric heater receiving portion to allow the electric heater receiving portion to protrude to the outside so as to be plastically deformed, thereby reducing the amount of material consumption that is unnecessarily consumed during the manufacture of the bracket.

DETAILED DESCRIPTION OF THE EMBODIMENTS

Figure 1:
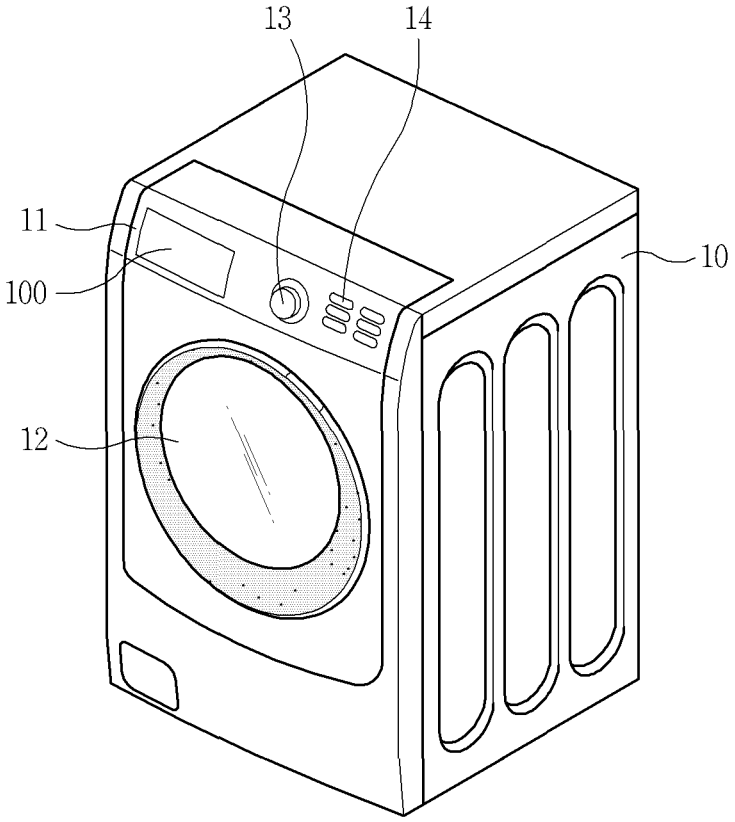
FIG. 1 is a perspective view illustrating a laundry treating apparatus according to an embodiment of the present disclosure.

Hereinafter, embodiments disclosed herein will be described in detail with reference to the accompanying drawings. Even in different embodiments according to the present disclosure, the same or similar reference numerals are designated to the same or similar configurations, and the description thereof will be substituted by the earlier description. Unless clearly used otherwise, expressions in the singular number used in the present disclosure may include a plural meaning. In describing the embodiments disclosed herein, moreover, the detailed description will be omitted when specific description for publicly known technologies to which the invention pertains is judged to obscure the gist of the present disclosure. Also, it should be noted that the accompanying drawings are merely illustrated to easily explain the concept of the invention, and therefore, they should not be construed to limit the technological concept disclosed herein by the accompanying drawings.

Figure 2:
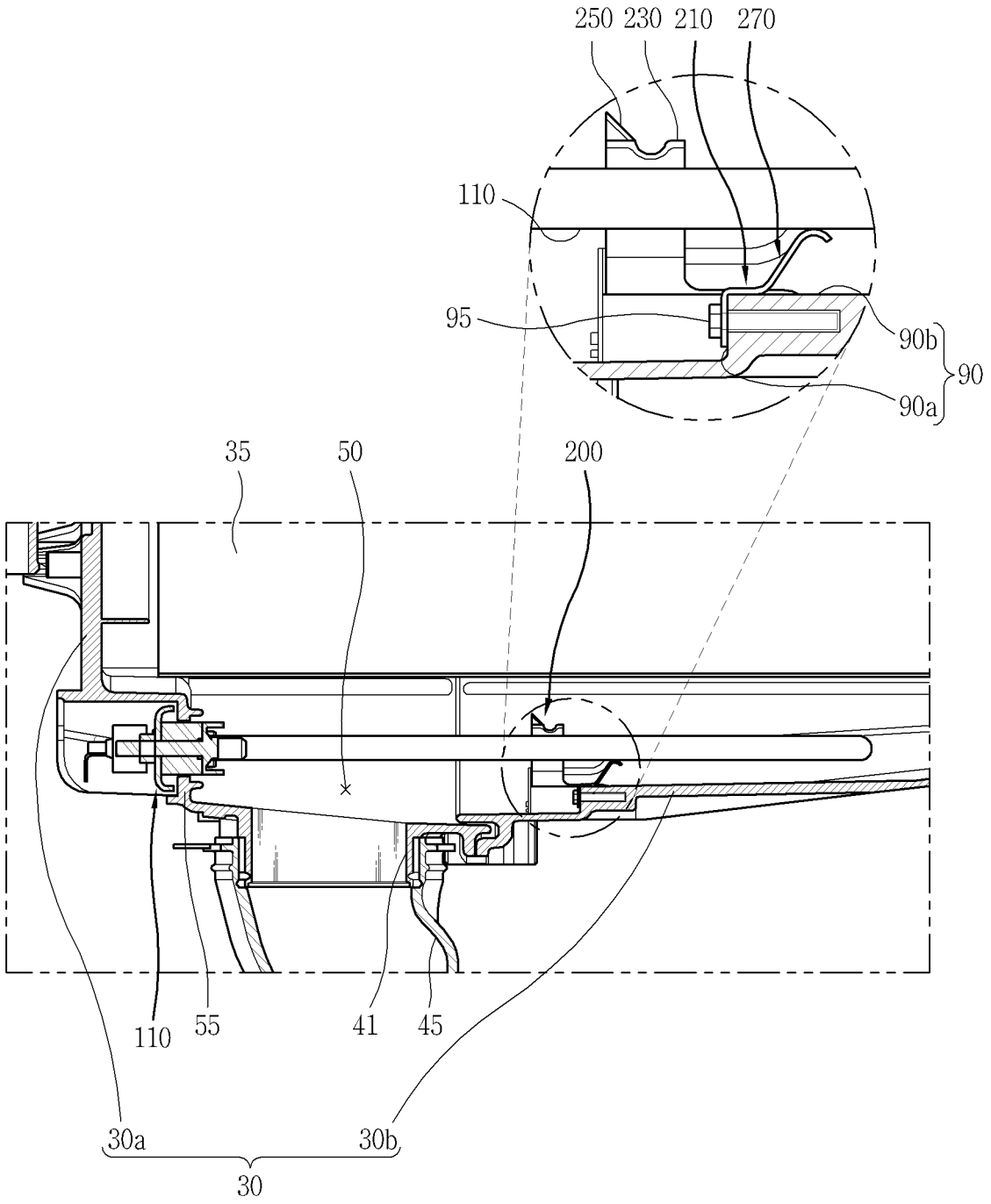
FIG. 2 is a cross-sectional view illustrating a main portion of the laundry treating apparatus in FIG. 1.

FIG. 1 is a perspective view illustrating a laundry treating apparatus according to an embodiment of the present disclosure, and FIG. 2 is a cross-sectional view illustrating a main portion of the laundry treating apparatus in FIG. 1. As illustrated in FIGS. 1 and 2, the laundry treating apparatus according to an embodiment of the present disclosure may include a cabinet 10, a tub 30, an electric heater 110, and a bracket 200.

The cabinet 10 defines an appearance and is implemented in a substantially rectangular parallelepiped shape. An entrance is disposed at a front surface of the cabinet 10 to allow laundry to enter and exit. The front side of the cabinet 10 is provided with a door 12 for opening and closing the entrance. A control panel 11 is provided at an upper side of the door 12 to select an operation mode. The control panel 11 is provided with, for example, a dial 13 and a plurality of operation buttons 14.

The tub 30 is provided inside the inner frame 10. The tub 30 defines a receiving space for wash water therein. The tub 30 has a cylindrical shape. A front side of the tub 30 is provided with an opening corresponding to the entrance. The tub 30 has a first tub 30*a* (front tub) and a second tub 30*b* (rear tub) which are coupled to each other along a front-rear of the cabinet 10. A drum 35 is rotatably received inside the tub 30. The drum 35 has a cylindrical shape with a front opening. Laundry is received in and withdrawn from the drum 35 through the entrance of the cabinet 10, the opening of the tub 30, and the opening of the drum 35.

The first tub 30*a* and the second tub 30*b* are integrally coupled to each other after the drum 35 is accommodated therein. The drum 35 is rotated about a rotating shaft (not shown) provided at the rear end. A rear region of the tub 30 is provided with a drive motor (not shown) for rotating the drum 35. The cabinet 10 is provided with a detergent box 100 for supplying detergent into the tub 30. A bottom portion of the tub 30 is provided with a drain pipe 45 to allow wash water therein to be drawn out. The first tub 30*a* is provided with a drain pipe connection portion 41 connected to the drain pipe 45.

On the other hand, a wash water collection space 50 is disposed at the bottom portion of the tub 30 to collect wash water. The wash water collection space 50 is provided with an electric heater 110 for heating wash water therein. The wash water collection space 50 is provided with an electric heater bracket or bracket 200 (hereinafter, referred to as a "bracket 200") for supporting the electric heater 110 to be spaced apart from the bottom surface. An electric heater coupling portion 55 coupled to the electric heater 110 is disposed in the wash water collection space 50. The electric heater 110 is hermetically coupled to the electric heater coupling portion 55 to suppress the leakage of wash water. In the present embodiment, it is illustrated that the electric heater coupling portion 55 is disposed in the first tub 30*a*, and the bracket 200 is coupled to the second tub 30*b*, but this is merely an example, and the present disclosure is not limited thereto. The electric heater coupling portion 55 may be disposed in the second tub 30*b*, and the bracket 200 may also be disposed in the first tub 30*a*.

Figure 3:
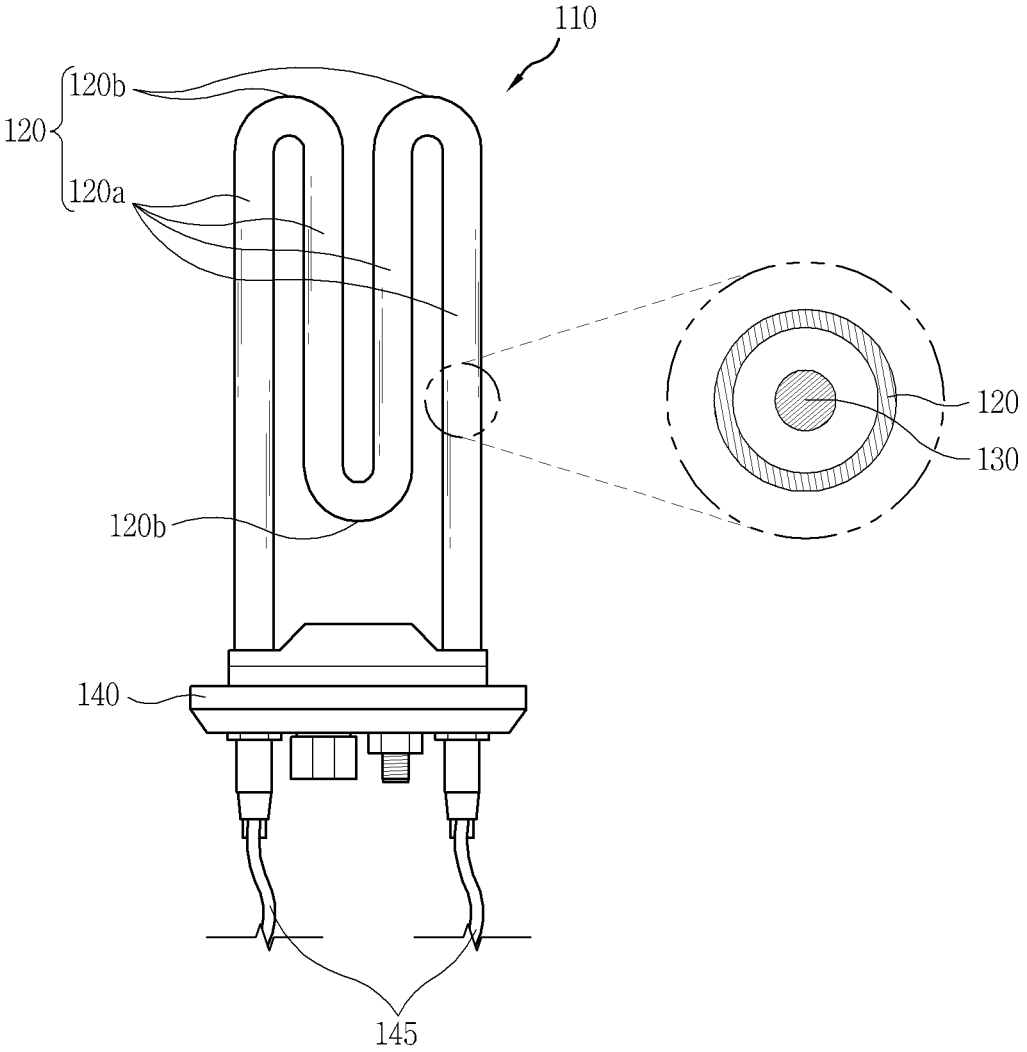
FIG. 3 is a plan view illustrating an electric heater in FIG. 2.

FIG. 3 is a plan view illustrating the electric heater 110 in FIG. 2. As illustrated in FIG. 3, the electric heater 110 includes a protection tube 120 having a receiving space therein and a heating wire 130 provided inside the protection tube 120 to generate heat when power is applied. As is well known, the heating wire 130 consists of an electric resistor, and generates electric resistance heat when power is applied. Although not specifically illustrated in the drawing, the heating wire 130 is electrically insulated from the protective tube 120 by an electric insulator. The heating wire 130 may be defined, for example, in a coil shape. The heating wire 130 is connected to a power supply line 145. When power is supplied to the heating wire 130 by the power supply line 145, the heating wire 130 generates heat. The protective tube 120 of the electric heater 110, for example, is defined by bending a long length of pipe having a predetermined diameter several times.

The protection tube 120 of the electric heater 110 includes a plurality of straight tube portions 120*a* arranged in parallel to each other and a curved tube portion 120*b* connecting the straight tube portions 120*a*. In the present embodiment, it is illustrated a case where four straight tube portions 120*a* three curved tube portions 120*b* are provided therein, but this is merely an example, but the present disclosure is not limited thereto. Among the four straight tube portions 120*a*, two straight tube portions 120*a* disposed at both outer sides thereof have a relatively long length, and two straight tube portions 120*a* disposed thereinside have a relatively short length. A support member 140 is provided at an end portion (a lower end portion in the drawing) of the two straight tube portions 120*a* disposed at the outer sides. The support member 140 is hermetically coupled to support the protection tube 120 and to suppress the leakage of wash water to the electric heater coupling portion 55. Among the four straight tube portions 120*a*, two straight tube portions 120*a* at the center have a relatively short length, and both ends thereof are connected to each other by the curved tube portion 120*b*. The protection tube 120 may be defined by bending a long length of pipe to define the four straight tube portions 120*a* and the three curved tube portions 120*b*. A gap is disposed between the curved tube portions 120*b* of the electric heater 110.

Figure 4:
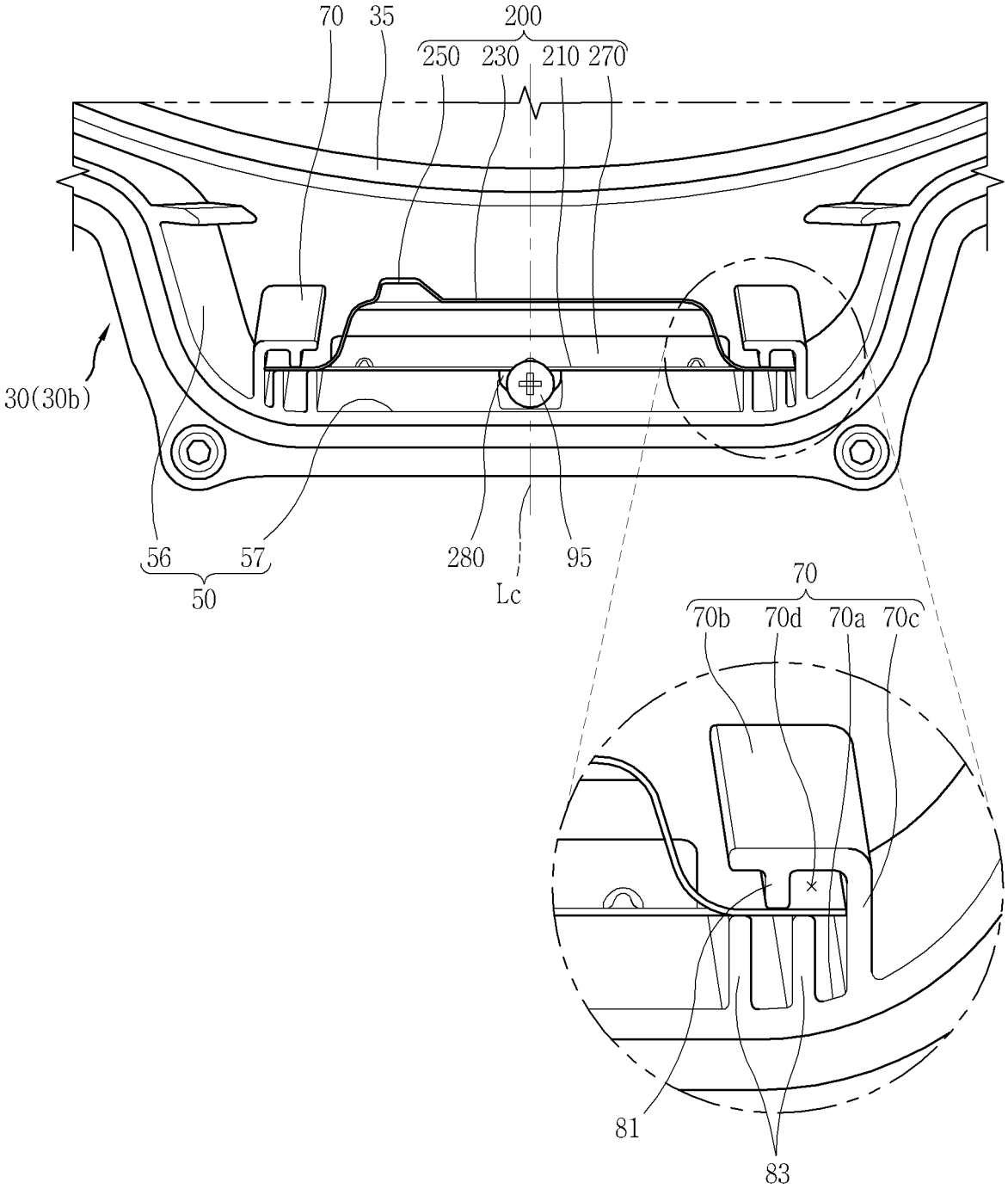
FIG. 4 is an enlarged front view illustrating a main portion of a wash water collection space provided with a bracket of a tub in FIG. 2.

FIG. 4 is an enlarged front view illustrating a main portion of the wash water collection space 50 provided with the bracket 200 of the tub 30 in FIG. 2. As illustrated in FIG. 4, the wash water collection space 50 protrudes downward at the center of the tub 30. The wash water collection space 50 is disposed at a size capable of receiving preset wash water therein. The wash water collection space 50 has a size capable of allowing the electric heater 110 to be immersed in water without being exposed to an outside of the water surface. The wash water collection space 50 has both side surfaces 56 thereof and a bottom surface 57 thereof, and has a rectangular cross-sectional shape with an open upper side thereof. The wash water collection space 50 is defined such that the both sides 56 thereof are spaced apart along a left-right direction of the cabinet 10.

The wash water collection space 50 is provided with a bracket coupling portion 70 coupled to the bracket 200. The bracket 200 has a length disposed along a left-right direction of the cabinet 10. More specifically, the wash water collection space 50 is disposed in both the first tub 30*a* and the second tub 30*b*. The bracket coupling portion 70 is disposed in the second tub 30*b*, for example. The bracket coupling portion 70 is defined to allow both sides of the bracket 200 to be inserted to a preset depth.

The bracket coupling portion 70 is disposed adjacent to both sides of the wash water collection space 50, respectively. The bracket coupling portion 70 is disposed substantially symmetrically with respect to the center line (Lc) along a left-right direction of the cabinet 10. The bracket coupling portion 70 has a "U" cross-sectional shape opened to the center side of the wash water collection space 50. The bracket coupling portion 70 includes a bottom surface portion 70*a*, an upper surface portion 70*b*, and a side surface portion 70*c*. Here, the bottom surface portion of the bracket coupling portion 70 actually defines part of the bottom surface of the wash water collection space 50. The bracket coupling portion 70 is provided with an upper support rib 81 and a lower support rib 83 in contact with upper and lower sides of the bracket 200, respectively, to support the bracket 200.

The upper support rib 81 protrudes downward from the upper surface portion 70*b* of the bracket coupling portion 70. The upper support rib 81 extends in a front-rear direction of the cabinet 10. The upper support rib 81 is spaced apart from the side surface portion 70*c* by a preset distance along a left-right direction of the cabinet 10. An engaging piece receiving space 70*d* is disposed between the side surface portion of the bracket coupling portion 70 and the upper support rib 81 to receive an engaging piece which will be described later.

The lower support rib 83 protrudes upward from the bottom surface portion of the bracket coupling portion 70. The lower support ribs 83 are provided with a pair arranged in parallel to each other. The lower support ribs 83 respectively extend along a front-rear direction of the cabinet 10. The lower support ribs 83 correspond to both sides of the upper support rib 81, respectively. An extension line of the upper support rib 81 corresponds between the lower support ribs 83.

The wash water collection space 50 is provided with a bracket support portion 90 in contact with a bottom surface of the bracket 200 to support the bracket 200. The bracket support portion 90 is defined in a step shape having a vertical surface 90*a* vertically disposed from a bottom surface of the wash water collection space 50 and a horizontal surface 90*b* (see FIG. 2). The vertical surface 90*a* and the horizontal surface 90*b* are defined in a left-right direction to connect between the bracket coupling portion 70. The screw coupling part 92 is provided on the vertical surface 90*a* of the bracket support portion 90 so that the screw 95 passing through the bracket 200 can be coupled thereto. The screw coupling portion 92 is provided with a female screw to allow a male screw of the screw 95 to be screw-coupled thereto. A region (a region of a base 210 and a supporter 270 which will be described later) of the bracket 200 is placed on the horizontal surface 90*b* of the bracket support portion 90, and supported by the horizontal surface 90*b*.

Figure 5:
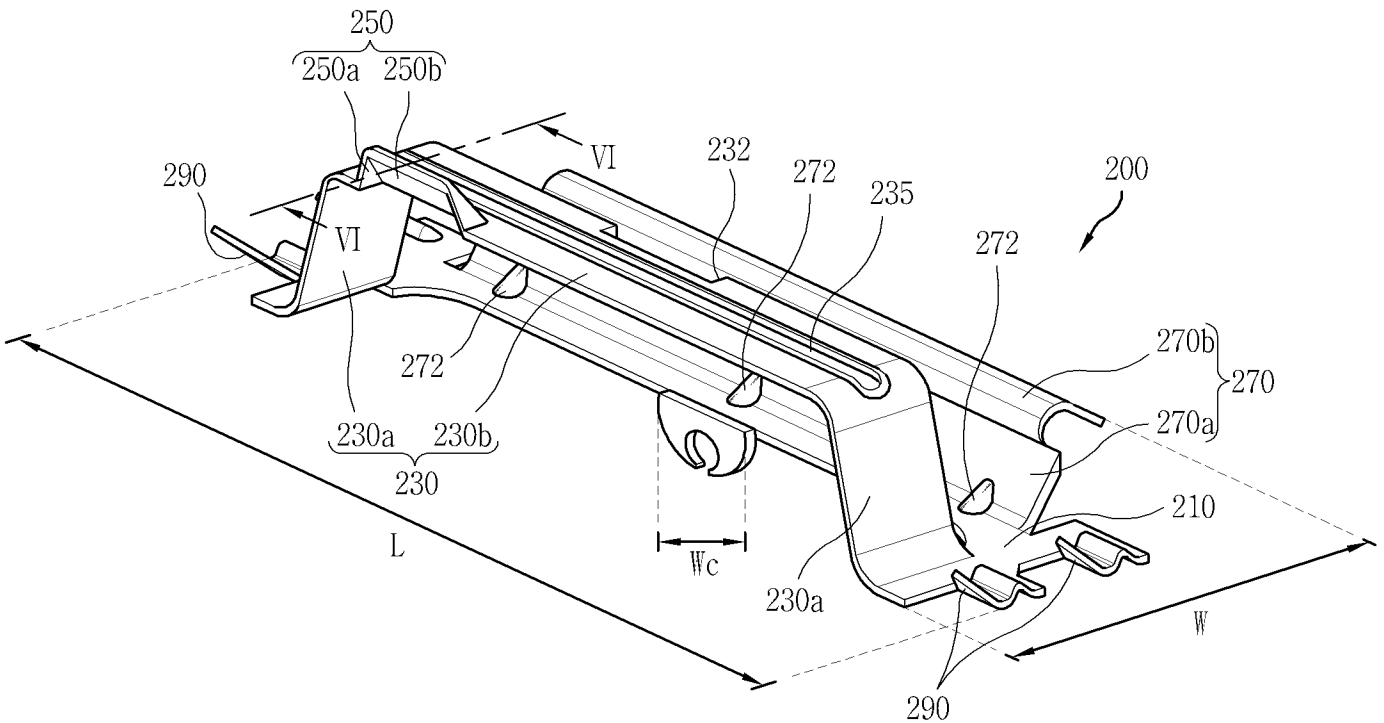
FIG. 5 is a perspective view illustrating the bracket in FIG. 4.
Figure 6:
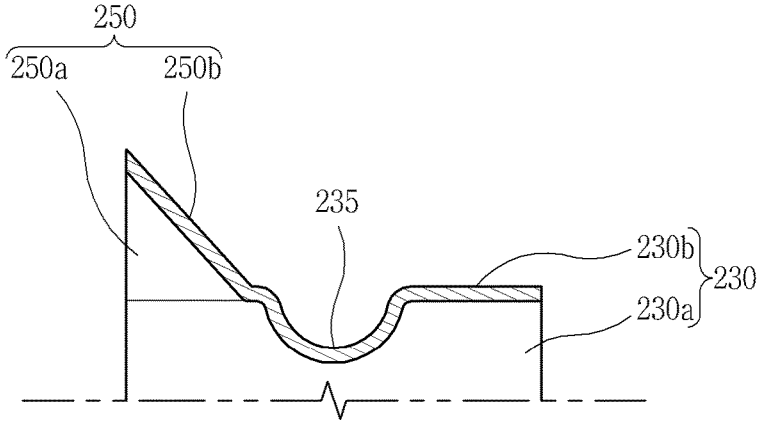
FIG. 6 is a cross-sectional view taken along line VI-VI of a sensing portion in FIG. 5.

FIG. 5 is a perspective view illustrating the bracket 200 in FIG. 4, and FIG. 6 is a cross-sectional view taken along line VI-VI of a sensing portion 250 in FIG. 5. As illustrated in FIG. 5, the bracket 200 includes an electric heater receiving portion 230 and a sensing portion 250. The bracket 200 is made of a metal member. The bracket 200 includes an electric heater receiving portion 230 in which the electric heater 110 is received. Here, the electric heater 110 is coupled to pass through an inside of the electric heater receiving portion 230, and a region of the electric heater 110 is received into the electric heater receiving portion 230.

The bracket 200 is defined by processing a substantially rectangular plate-shaped metal member (base material). The bracket 200 has a length (L) (a left-right width on the drawing) corresponding to a width of the electric heater 110 and a width (W) (a front-rear width on the drawing) reduced compared to the length. In the present embodiment, it is illustrated a case where a left-right width (length (L)) of the bracket 200 is defined to be larger than a front-rear width (width (W)) thereof, but this is merely an example, and the present disclosure is not limited thereto.

The bracket 200 includes a base 210 and an electric heater receiving portion 230 protrude upward from the base 210. The electric heater receiving portion 230 is defined to have an inner width capable of receiving the straight tube portion 120*a* of the electric heater 110. The electric heater receiving portion 230 is disposed with an open lower side. More specifically, the electric heater receiving portion 230 may be configured such that a compressive force is applied upward to a region (a front region in the present embodiment) of the base 210 to be plastically deformed so as to allow both side surface portions 250*a* and the upper surface portions 250*b* to have an inverted-"U" cross-sectional shape.

One side of the electric heater receiving portion 230 is provided with a supporter 270 for supporting the electric heater 110 from below. The supporter 270 is disposed at a rear region of the electric heater receiving portion 230. The bracket 200 is provided with an engaging piece 290 that is caught by the bracket coupling portion 70 to suppress the bracket 200 from being released while being inserted into the bracket coupling portion 70. The engaging pieces 290 are disposed at both sides of the base 210, respectively. The engaging pieces 290 are disposed in plurality numbers to be spaced apart from each other along a front-rear direction of the cabinet 10. In the present embodiment, it is illustrated a case where four engaging pieces 290 are in pairs at both sides of the bracket 200, but this is merely an example, and the present disclosure is not limited thereto.

On the other hand, the bracket 200 has a sensing portion 250 protruding upward at a point moved by a preset distance from the center of the electric heater receiving portion 230 (indicated by the center line (Lc)) to one side (a left side on the drawing). Here, when the sensing portion 250 is disposed in a central region of the electric heater receiving portion 230, interference occurrence between a front end portion (curved tube portion 120*b*) of the electric heater 110 and the sensing portion may be increased during the insertion of the electric heater 110. In addition, in case where the sensing portion (not shown) is disposed at an upper center of the electric heater receiving portion 230, when the electric heater 110 is inserted into an upper side of the sensing portion at the center, the electric heater 110 maintains a horizontal state, and thus it is not distinguished from a case where the electric heater 110 is normally inserted into the electric heater receiving portion 230, thereby making it difficult to identify the mis-assembly of the electric heater 110.

In the present embodiment, it is illustrated a case where the sensing portion 250 is disposed at a point moved to the left from the center (center line (Lc)) of the electric heater receiving portion 230 along a left-right direction of the cabinet 10, but this is merely an example, and the sensing portion may also be disposed at a point moved to an upper right side of the electric heater receiving portion 230 although not illustrated in detail on the drawing.

The sensing portion 250 is pressurized from an inside of the electric heater receiving portion 230 to be recessed upward to protrude to an outside thereof. The sensing portion 250 includes both side surface portions 250*a* and an upper surface portion 250*b*. As illustrated in FIG. 6, the upper surface portion 250*b* of the sensing portion 250 is inclined downward and connected to the upper surface portion 230*b* of the electric heater receiving portion 230. A bead 235 is disposed at a rear side of the sensing portion 250. The bead 235 is recessed downward. The electric heater receiving portion 230 is disposed with a cut-out portion 232 that is cut out rearward.

The supporter 270 is provided with an inclined portion 270*a* inclined upward from the base 210. The supporter 270 is provided with a round portion 270*b* that is bent to have a curved cross-sectional shape at an upper end of the inclined portion 270*a*. According to this, when the electric heater 110 is received in the electric heater receiving portion 230, a front end portion (curved tube portion 120*b*) of the electric heater 110 moves upward along the inclined portion 270*a* to efficiently perform the insertion of the electric heater 110. In addition, after the insertion of the electric heater 110, a contact between the round portion 270*b* and the electric heater 110 is efficiently carried out. In other words, the scratch, damage, and friction of the electric heater 110 and/or the supporter 270 are reduced to facilitate the assembly of the electric heater 110. A plurality of beads 272 for reinforcement are disposed in a boundary region between the base 210 and the inclined portion 270*a*.

The bracket 200 has a screw fastening portion 280 to be fixed by a screw 95 to the tub 30 when the bracket coupling portion 70 is coupled thereto. The screw fastening portion 280 extends downward from the base 210. The screw fastening portion 280 passes through a screw hole 282 so as to insert the screw 95 thereinto. The screw hole 282 is open downward. The screw fastening portion 280 is configured to have, for example, a width (Ws) greater than an inner width (gap) between the straight tube portions 120*a* at the center of the electric heater 110.

Figure 7:
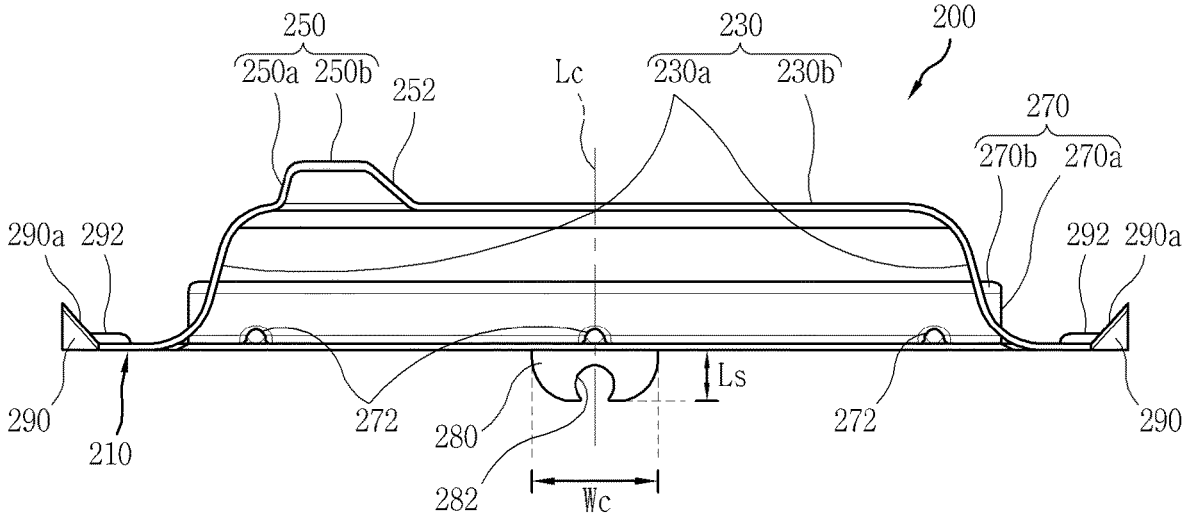
FIG. 7 is a front view illustrating the bracket in FIG. 5.

FIG. 7 is a plan view illustrating the bracket 200 in FIG. 5. As illustrated in FIG. 7, the sensing portion 250 includes both side surface portions 250*a* and an upper surface portion 250*b*. A side surface portion (a right side surface portion in the drawing) disposed adjacent to the center (center line (Lc)) of the electric heater receiving portion 230 along a left-right direction of the cabinet 10 between the both side surface portions 250*a* has a guide inclined surface 252 inclined downward toward the center (center line (Lc)). The guide inclined surface 252 may be an outer surface of one side surface portion 250*a* of the sensing portion 250 (a right side on the drawing). According to this configuration, when the electric heater 110 is incorrectly inserted into an upper side of the electric heater receiving portion 230, a left portion (a straight tube portion 120*a*) of the electric heater 110 may be efficiently guided upward by the guide inclined surface 252 without significant interference, thereby allowing the electric heater 110 to be easily switched (disposed) to an inclined position that is inclined with respect to the horizontal line.

The screw fastening portion 280 is provided at the center of the bracket 200. The screw fastening portion 280 is bent downward from the base 210. A front region of the engaging pieces 290 that are respectively provided at both sides of the bracket 200 are formed such that the front region is inclined upward. Each of the engaging pieces 290 is reduced in width toward the front. The outer surfaces of each of the engaging pieces 290 that are disposed at both sides of the bracket 200 are disposed in parallel to each other. A tip portion 290*a* is disposed at a front end of each engaging piece 290. Each of the engaging pieces 290 is defined at a length that can be inserted into the engaging piece receiving space 70*d* and brought into contact with an inner surface (ceiling) of the engaging piece receiving space 70*d* to be inserted while sliding when coupled to the bracket coupling portion 70. The tip portion 290*a* on each of the engaging pieces 290 is brought into contact with and inserted into an inner surface (ceiling) of the upper surface portion 70*b* of the bracket coupling portion 70 when the bracket 200 is withdrawn out, thereby suppressing the bracket 200 from being unintentionally withdrawn out. Here, since the engaging piece 290 is made of a metal member and the bracket coupling portion 70 is made of a plastic member, the tip portion 290*a* of the engaging piece 290 may be easily penetrated (inserted) into a structure of the bracket coupling portion 70 by a small external force. As a result, the bracket 200 may be suppressed from being unintentionally withdrawn out (disconnected) from the bracket coupling portion 70.

Figure 8:
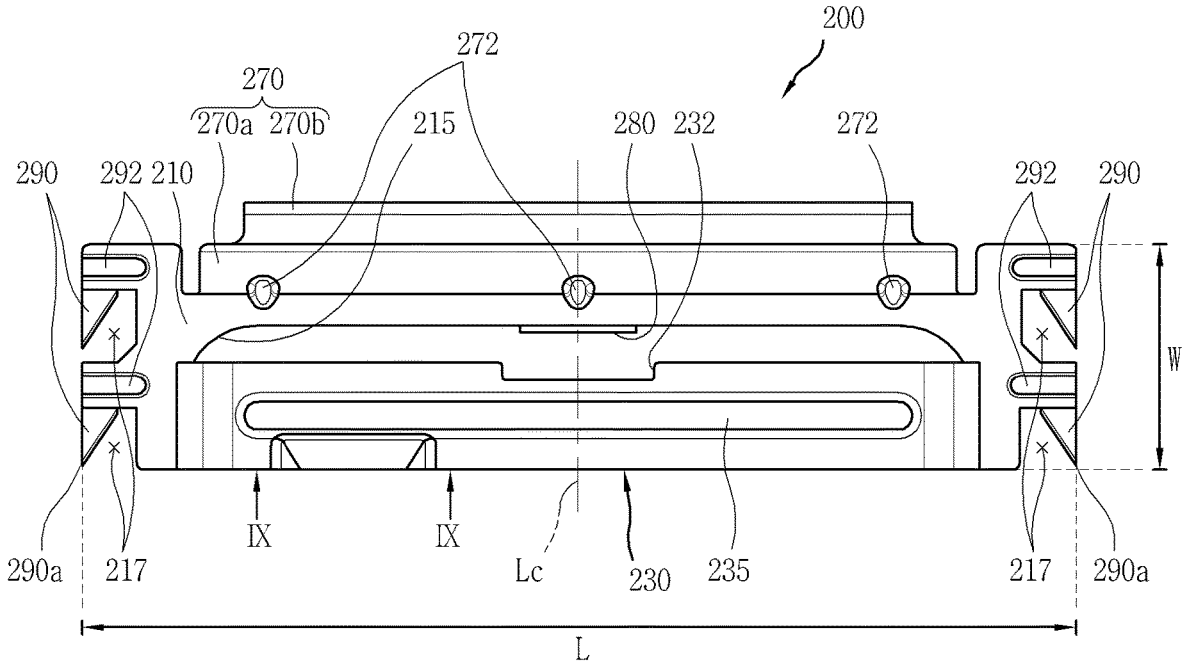
FIG. 8 is a plan view illustrating the bracket in FIG. 5.
Figure 9:
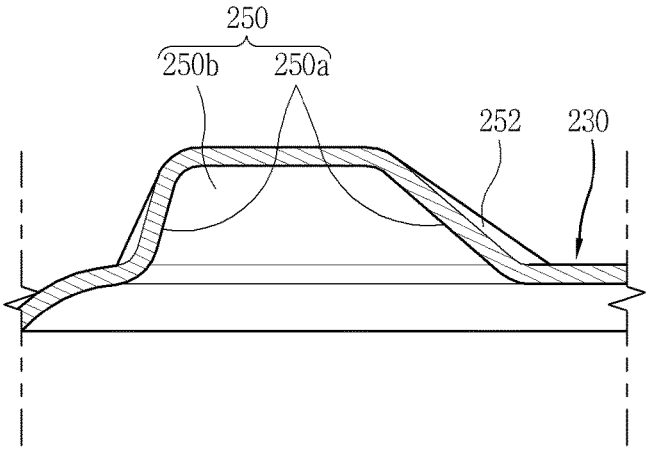
FIG. 9 is a cross-sectional view taken along line IX-IX of a sensing portion in FIG. 8.
Figure 10:
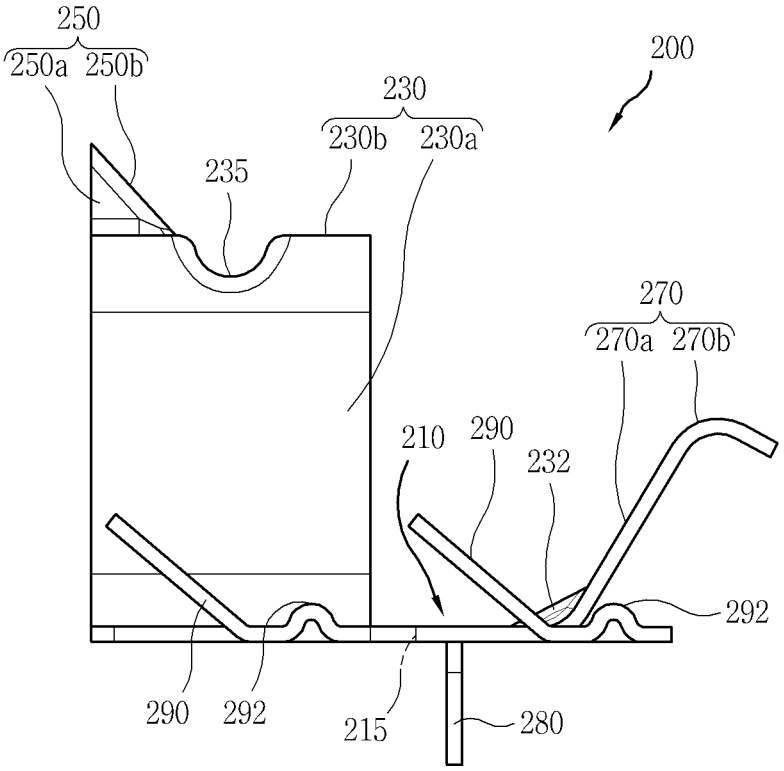
FIG. 10 is a side view illustrating the bracket in FIG. 5.

FIG. 8 is a plan view illustrating the bracket 200 in FIG. 5, and FIG. 9 is a cross-sectional view taken along line IX-IX of the sensing portion 250 in FIG. 8, and FIG. 10 is a side view illustrating the bracket 200 in FIG. 5. As illustrated in FIGS. 8 through 10, the electric heater receiving portion 230 is disposed with a cut-out portion 232 that is cut out rearward. The cut-out portion 232 is disposed at a position corresponding to the screw fastening portion 280 which will be described later. The cut-out portion 232 is cut out during the formation of the screw fastening portion 280. According to this, it may not be required to increase a separation width of the cut-out portion 217 which will be described later from the electric heater receiving portion 230 to define the screw fastening portion 280, thereby reducing a width length of the base material of the bracket 200 by that amount. As a result, a material consumption amount of the base material of the bracket 200 may be reduced.

A pair of engaging pieces 290 are disposed at both sides of the bracket 200, respectively, to be spaced apart from each other along a front-rear direction. One side of the engaging piece 290 is disposed with the cut-out portion 217 that is cut out to define each of the engaging pieces 290. One side of each of the engaging pieces 290 is respectively disposed with a bead 292 for reinforcement.

On the other hand, the inclined portion 270*a* has a reduced length compared to the base 210. The round portion 270*b* has a reduced length compared to the inclined portion 270*a*. In the present embodiment, it is illustrated that both side surface portions 250*a* of the sensing portion 250 have different inclinations as shown in FIG. 9, but this is merely an example, and the both side surface portions 250*a* of the sensing portion 250 may be configured to have the same slope as each other.

Referring back to FIG. 8, a cut-out portion 215 is disposed in the base 210 behind the electric heater receiving portion 230. The cut-out portion 215 has a length corresponding to that of the electric heater receiving portion 230. As a result, the electric heater receiving portion 230 may be separated from the base 210 to protrude upward during the formation of the electric heater receiving portion 230. In addition, an entire weight of the bracket 200 may be reduced by the cut-out portion 215. The screw fastening portion 280 is disposed at the center of the cut-out portion 215.

In the present embodiment, it is illustrated that the electric heater receiving portion 230 is disposed at the front side and the supporter 270 is disposed at a rear side of the electric heater receiving portion 230, but this is merely an example, and the present disclosure is not limited thereto. However, the electric heater receiving portion 230 disposed at a front side of the supporter 270 may be more preferable than the electric heater receiving portion 230 disposed at a rear side of the supporter 270 to reduce a width of a rectangular plate-shaped metal member (base material) for defining the bracket 200, and reduce an amount of material consumption. More specifically, a portion corresponding to the protruding length (Ls) (see FIG. 7) of the screw fastening portion 280 may overlap with (cut-out portion 232) a rear end of the electric heater receiving portion 230 so as to reduce a width (W) of the base material of the bracket 200 by that amount, thereby significantly reducing a material consumption amount of the base material of the bracket 200.

Figure 11:
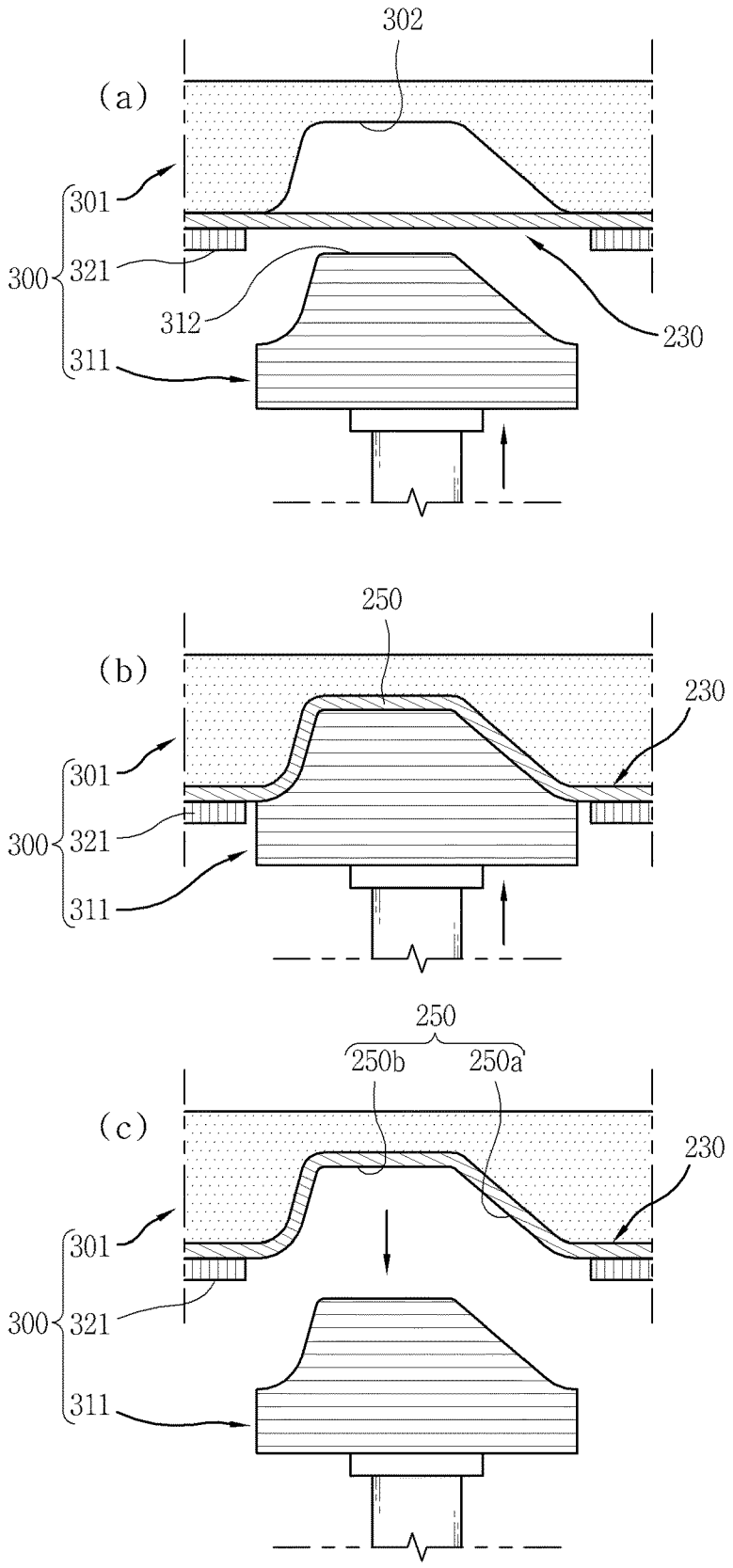
FIG. 11 is a view for explaining a process of defining the sensing portion of the bracket in FIG. 5.

FIG. 11 is a view for explaining a process of defining the sensing portion 250 of the bracket 250 in FIG. 5. The sensing portion 250 may be defined, for example, by a machining process so-called drawing to mold a plate-shaped metal member using a metal mold. More specifically, the sensing portion 250 is molded by a sensing portion molding apparatus 300 for performing plastic deformation in a preset shape by applying a predetermined compressive force to one region of the electric heater receiving portion 230.

The sensing portion molding apparatus 300 may include, for example, a first mold (or die) 301 disposed with an inner molding surface 302 corresponding to an external shape of the sensing portion 250 at an inside thereof and a second mold (or punch) 311 disposed with an outer molding surface 312 corresponding to an inner shape of the sensing portion 250 at an outer surface thereof. A fixing portion (or guide) for fixing the upper surface portion 230*b* of the electric heater receiving portion 230 and guiding the second mold 311 to be inserted inward in cooperation with the first mold 301 is disposed on an inner surface of the electric heater receiving portion 230.

By this configuration, as illustrated in (a) of FIG. 11, the first mold 301 is disposed at an upper side of the electric heater receiving portion 230, and the fixing portion 321 is disposed on an inner surface of the electric heater receiving portion 230, and the electric heater receiving portion 230 is firmly fixed and supported by the first mold 301 and the fixing portion 321.

When the electric heater receiving portion 230 is fixedly supported, the second mold 311 is inserted into the fixing portion 321 to upwardly pressurize a region of the electric heater receiving portion 230 (a formation region of the sensing portion 250). As illustrated in (b) of FIG. 11, a region of the electric heater receiving portion 230 is upwardly pressurized to define the sensing portion 250 to be recessed from the inner side to protrude to the outside. When the sensing portion 250 is defined, the second mold 311 is returned to an initial position as illustrated in (c) of FIG. 11.

By this configuration, when the bracket 200 is to be coupled to the bracket coupling portion 70, the bracket 200 is disposed at an inlet of the bracket coupling portion 7 such that the electric heater receiving portion 230 faces a front side of the cabinet 10. When both side surface portions of the base 210 of the bracket 200 are inserted between the upper support rib 81 and the lower support ribs 83, respectively, and the bracket 200 is pushed backward, the bracket 200 is inserted into the bracket coupling portion 70 while being slid. Each engaging piece 290 of the bracket 200 slides in contact with an inner surface (ceiling surface) of the upper surface portion 70*b* of the bracket coupling portion 70.

When the bracket 200 is continuously inserted, the screw fastening portion 280 of the bracket 200 is brought into contact with the bracket support portion 90 (vertical surface 90*a*) to stop the insertion of the bracket 200. At this time, the base 210 of the bracket 200 is placed on an upper surface of the horizontal surface 90*b* of the bracket support portion 90 to be supported by the bracket support portion 90. When the insertion of the bracket 200 is stopped, the screw 95 is inserted into the screw fastening portion 280 of the bracket 200 to allow the bracket 200 to be fixedly coupled to the bracket support portion 90.

Figure 12:
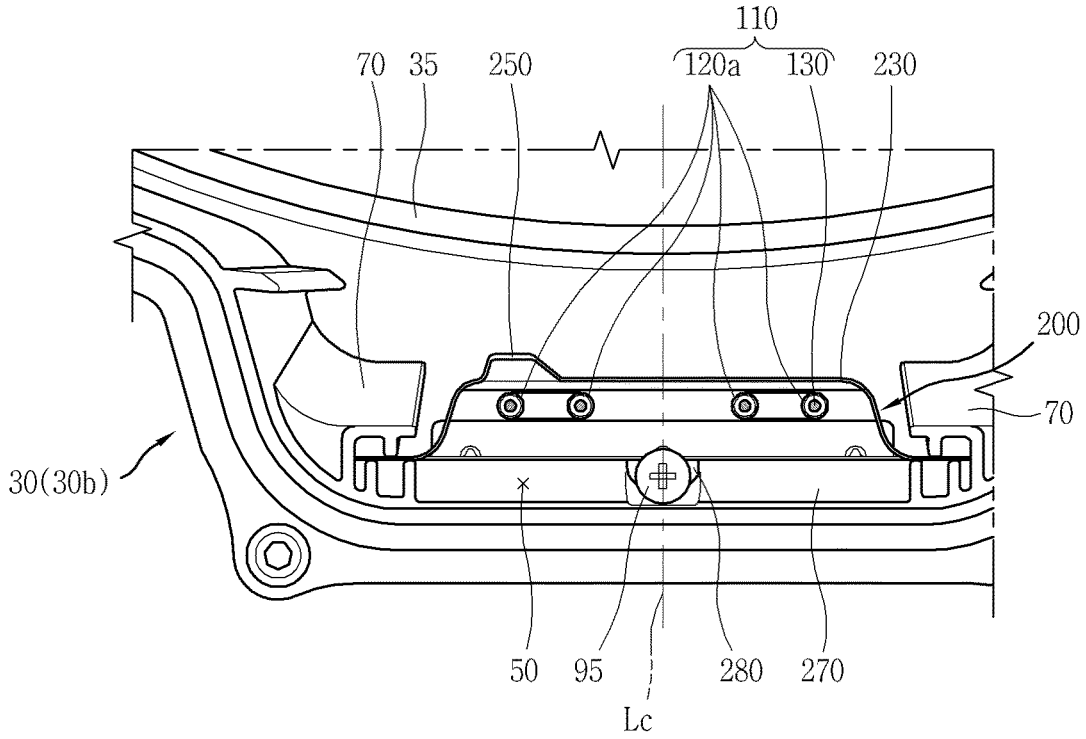
FIG. 12 is a view illustrating a horizontal position at which an electric heater is normally assembled into the bracket in FIG. 4.
Figure 13:
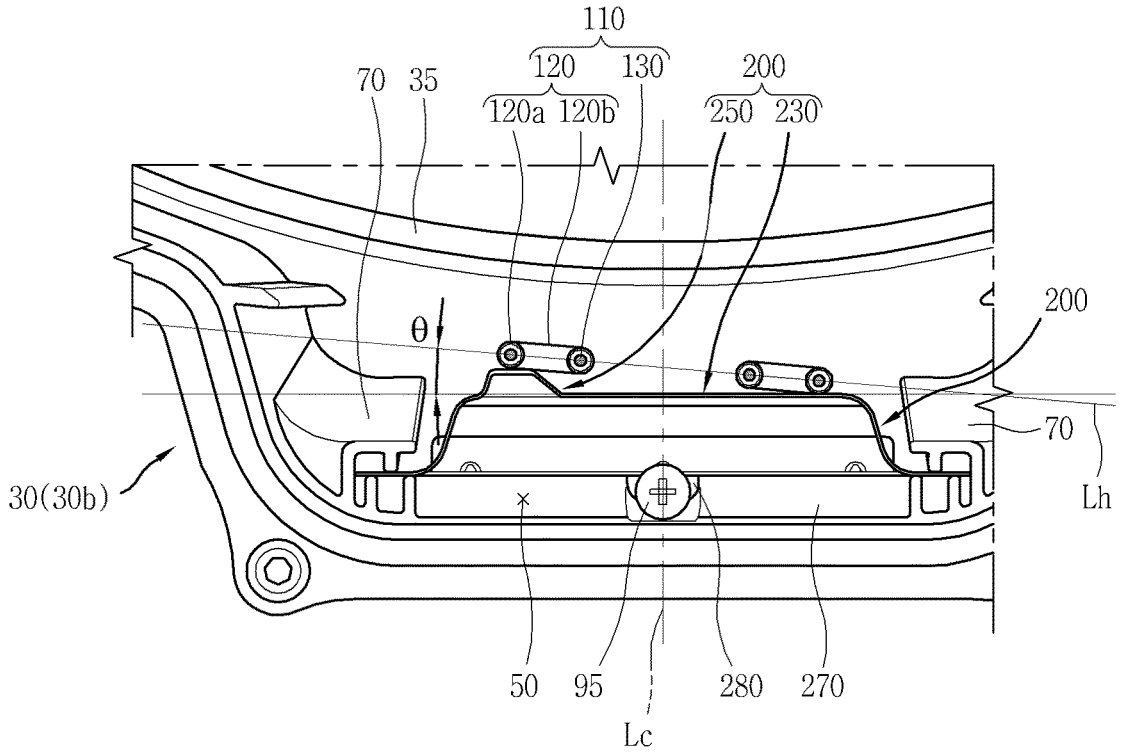
FIG. 13 is a view illustrating an inclined position at which an electric heater is mis-assembled at an upper side of an electric heater receiving portion of the bracket in FIG. 4.
Figure 14:
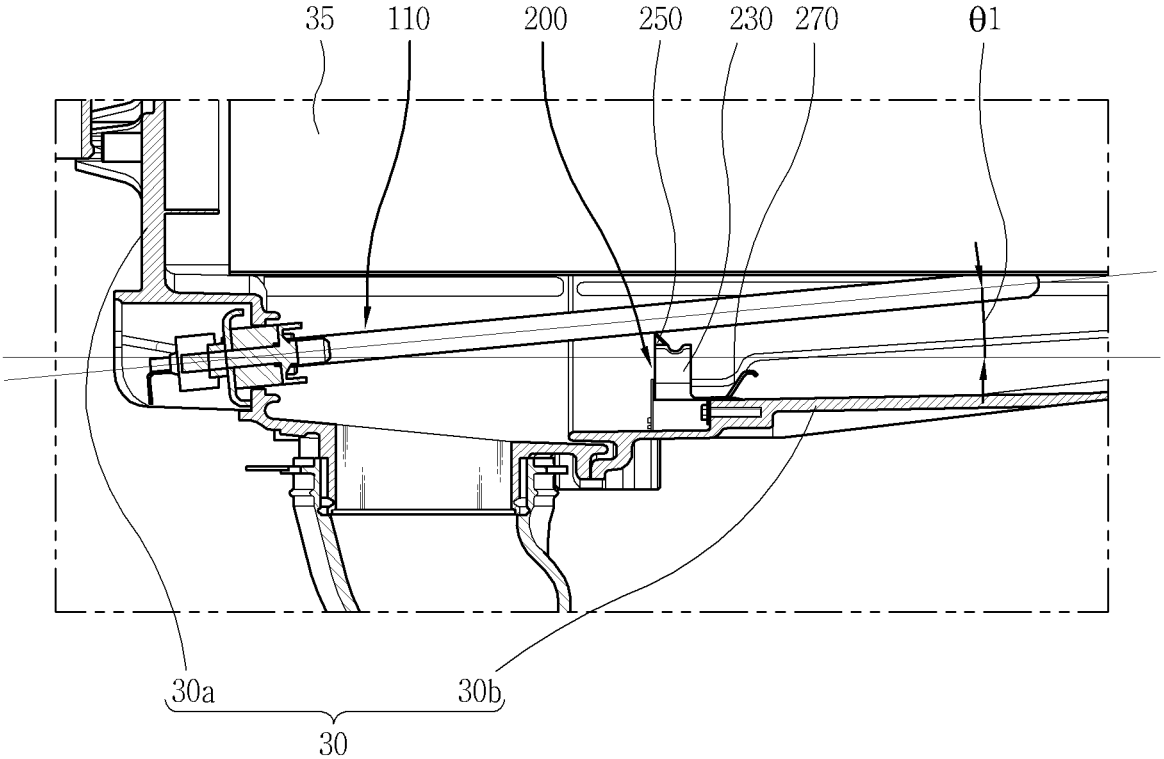
FIG. 14 is a side view illustrating the electric heater in FIG. 13.
Figure 15:
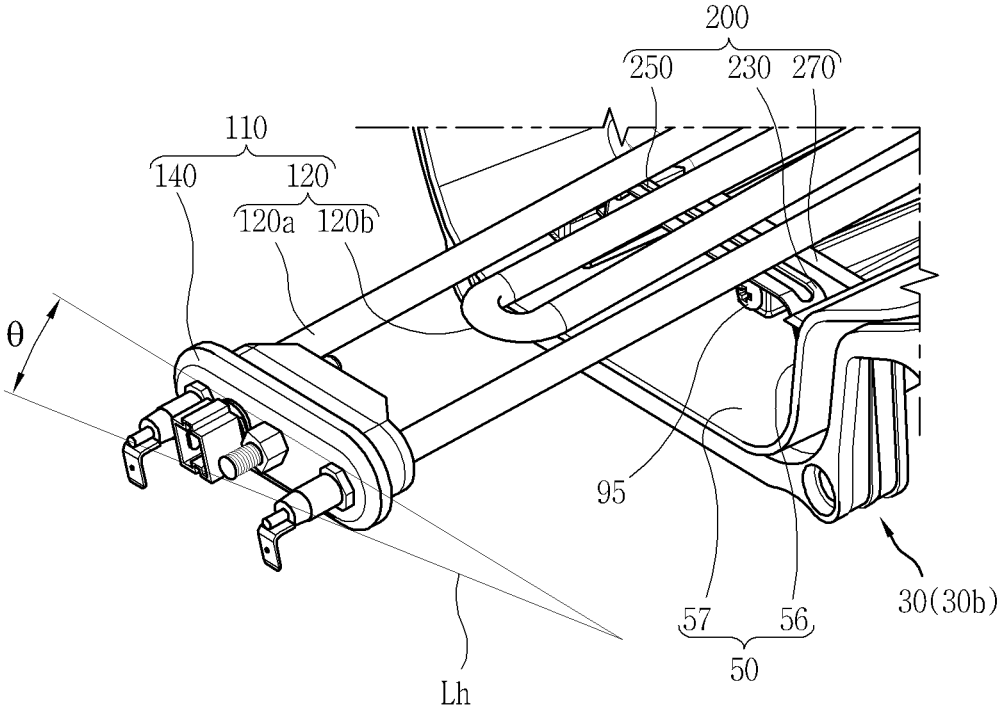
FIG. 15 is a perspective view illustrating the electric heater in FIG. 13.

FIG. 12 is a view illustrating a horizontal position at which the electric heater 110 is normally assembled into the bracket 200 in FIG. 4, and FIG. 13 is a view illustrating an inclined position at which the electric heater 110 is mis-assembled at an upper side of the electric heater receiving portion 230 of the bracket 200 in FIG. 4, and FIG. 14 is a side view illustrating the electric heater 110 in FIG. 13, and FIG. 15 is a perspective view illustrating the electric heater 110 in FIG. 13.

When the coupling of the bracket 200 is completed, the electric heater 110 is inserted into the tub 30 (laundry collection space 50) through the electric heater coupling portion 55 while the electric heater 110 is disposed horizontally at a front side of the tub 30.

First, a case where the electric heater 110 is normally assembled will be described with reference to FIG. 12.

When the electric heater 110 is inserted into a rear side of the wash water collection space 50, a front end portion of the electric heater 110 is inserted into the electric heater receiving portion 230 of the bracket 200.

When the electric heater 110 is continuously inserted backward, the front end portion of the electric heater 110 moves upward along the inclined portion 270*a*, and the straight tube portion 120*a* of the electric heater 110 is placed on an upper end of the round portion 270*b* to be disposed at a horizontal position. At this time, the operator is unable to visually check that the straight tube portion 120*a* is supported by the round portion 270*b*, but it may be easily recognized by the support member 140 of the electric heater 110 being horizontally disposed at an outside of the tub 30. The support member 140 is hermetically coupled to the electric heater coupling portion 55.

On the other hand, a case where the electric heater 110 is mis-assembled will be described with reference to FIGS. 13 through 15.

When inserting the electric heater 110 into a rear side of the wash water collection space 50, the operator is in a state where it is difficult to perform visual check, and thus it may occur a case where a front end portion of the electric heater 110 is inserted into an upper side of the electric heater receiving portion 230 due to the inclination and/or torsion of the electric heater 110.

When a front end portion of the electric heater 110 is inserted into an upper side of the electric heater receiving portion 230 other than an inside of the electric heater receiving portion 230, a right region of the electric heater 110 may be brought into contact with the bracket coupling portion 70. The right region of the electric heater 110 is brought into contact with the bracket coupling portion 70 and inserted into a left region of the bracket coupling portion 70. At this time, the left region of the electric heater 110 is moved upward in contact with a guide inclined surface 252 of the sensing portion 250, and the straight tube portion 120*a* of the electric heater 110 is disposed at an inclined position that is inclined with respect to the horizontal line as illustrated in FIG. 13.

Accordingly, the support member 140 of the electric heater 110 is disposed at an inclined position that is inclined to define a preset inclination angle (8) with respect to the horizontal line as illustrated in FIG. 15. Since the support member 140 is disposed at an inclined position that is inclined with respect to the horizontal line, the operator may visually check and recognize that the electric heater 110 is in a m is-assembled state.

In addition, as illustrated in FIG. 14, as the straight tube portion 120*a* at a left side of the electric heater 110 is supported by the sensing portion 250, a front end portion of the electric heater 110 may be inclined upward at an inclination angle (81) with respect to the horizontal line and brought into contact with the drum 35 at an upper side thereof, thereby allowing the operator to easily sense (or identify) the m is-assembly state of the electric heater 110.

In the above, preferred embodiments of the present disclosure are illustrated and described herein with reference to the accompanying drawings. However, the present disclosure may be implemented in various embodiments without departing from the concept or gist of the invention, and thus the foregoing embodiments should not be limited to the content of the detailed description.

Furthermore, the foregoing embodiments should be broadly construed within the scope of the technical concept defined by the appended claims even though they are not specifically disclosed in the detailed description herein. Moreover, all changes and modifications within the technical scope of the claims and the equivalent scope thereof should be construed to be included in the appended claims.

What is claimed is:

1. A laundry treating apparatus, comprising:

a cabinet;

a tub disposed inside the cabinet;

a drum disposed inside the tub;

an electric heater coupled to a bottom portion of the tub and configured to heat wash water in the tub; and a bracket that is disposed at the tub and that supports the electric heater to be spaced apart from the bottom portion of the tub, the bracket comprising:

an electric heater receiving portion that is configured to receive the electric heater to a predetermined position, and a sensing portion that protrudes upward from an upper side of the electric heater receiving portion and is disposed at a position shifted to one of a left side or a right side of a center line of the electric heater receiving portion to thereby enable detection of whether the electric heater is received at the predetermined position in the electric heater receiving portion, wherein the sensing portion comprises a guide inclined surface that has a triangular shape facing the center line in a left-right direction and that is inclined with respect to the upper side of the electric heater receiving portion, the guide inclined surface extending toward the center line in the left-right direction and downward to the upper side of the electric heater receiving portion, wherein the tub includes a first tub and a second tub that are coupled to each other, the first tub including an electric heater coupling portion coupled to the electric heater, and the second tub being coupled to the bracket, wherein the electric heater comprises:

a plurality of straight tube portions, a plurality of curved tube portions, each of the plurality of curved tube portions connecting the plurality of straight tube portions, and a support member coupled to two straight tube portions among the plurality of straight tube portions, the support member being coupled to the electric heater coupling portion from an outside of the first tub, and wherein the guide inclined surface is configured to contact and guide the electric heater to move upward with respect to a horizontal line such that the support member is disposed at an inclined position defining a preset inclination angle with respect to the horizontal line.

2. The laundry treating apparatus of claim 1, wherein the sensing portion is recessed from an inner side of the electric heater receiving portion and protrudes to an outside of the electric heater receiving portion.

3. The laundry treating apparatus of claim 1, wherein the sensing portion has an upper surface that is inclined with respect to the upper side of the electric heater receiving portion, that extends downward and in a rear direction, and that is connected to the upper side of the electric heater receiving portion and the guide inclined surface.

4. The laundry treating apparatus of claim 1, wherein the bracket further comprises:

a base; and a supporter that is spaced apart upward from the base and that supports the electric heater from a position vertically below the electric heater.

5. The laundry treating apparatus of claim 4, wherein the supporter is disposed in a rear region of the electric heater receiving portion.

6. The laundry treating apparatus of claim 4, wherein the supporter comprises an inclined portion that is inclined with respect to the base and that extends upward from the base in a rear direction.

7. The laundry treating apparatus of claim 6, wherein the supporter further comprises a round portion that has a curved cross-sectional shape and that is disposed at an upper end of the inclined portion.

8. The laundry treating apparatus of claim 7, wherein the round portion extends in parallel to the base.

9. The laundry treating apparatus of claim 4, wherein the bracket further comprises a screw fastening portion that extends downward from a center of the base.

10. The laundry treating apparatus of claim 9, wherein the screw fastening portion is disposed at a position corresponding to a center of the supporter, and wherein the base has cut-out portions that are defined at a front side of the supporter, the cut-out portions being defined at both sides of the screw fastening portion, respectively.

11. The laundry treating apparatus of claim 1, wherein the tub has a wash water collection space defined at the bottom portion of the tub and configured to collect wash water, and wherein the laundry treating apparatus further comprises a bracket coupling portion that is disposed in the wash water collection space and that is coupled to the bracket.

12. The laundry treating apparatus of claim 11, wherein the bracket coupling portion comprises bracket coupling portions that are spaced apart from each other and that couple to both side portions of the bracket, respectively, and wherein the bracket is configured to be inserted into the bracket coupling portions by a predetermined width.

13. The laundry treating apparatus of claim 11, wherein the bracket coupling portion comprises:

an upper support rib that contacts and supports an upper side of the bracket; and a lower support rib that contacts and supports a lower side of the bracket.

14. The laundry treating apparatus of claim 11, wherein the bracket comprises an engaging piece that is configured to be caught by the bracket coupling portion to thereby restrict separation of the bracket and the bracket coupling portion based on the bracket being inserted into the bracket coupling portion.

15. The laundry treating apparatus of claim 14, wherein the engaging piece is inclined upward with respect to a bottom surface of the bracket and extends toward a front side of the bracket.

16. The laundry treating apparatus of claim 11, wherein the bracket coupling portion is made of a plastic material.

17. The laundry treating apparatus of claim 1, wherein the bracket is made of metal, and wherein the sensing portion is protruded from the electric heater receiving portion by deforming the bracket with a preset compressive force.

18. The laundry treating apparatus of claim 1, wherein a width of the guide inclined surface decreases as the sensing portion extends upward from the upper side of the electric heater receiving portion.

19. The laundry treating apparatus of claim 1, wherein the first tub and the second tub are arranged along a front-rear direction of the cabinet.

20. The laundry treating apparatus of claim 1, wherein the sensing portion is configured to, based on the electric heater being installed outside the electric heater receiving portion, cause the support member of the electric heater to be disposed at the inclined position to thereby indicate a mis-assembly of the electric heater.

* * * * *